United States Patent [19]

Ferguson et al.

[11] Patent Number: 4,780,948

[45] **Date of Patent: * Nov. 1, 1988**

[54] FORGED DISSIMILAR METAL ASSEMBLY AND METHOD

[75] Inventors: John H. Ferguson, Sauquoit; Dana P. Perkins, deceased, late of New Hartford, both of N.Y., by Marjorie F. Perkins, executrix

[73] Assignee: Parker-Hannifin Corporation, Cleveland, Ohio

[ * ] Notice: The portion of the term of this patent subsequent to Sep. 2, 2003 has been disclaimed.

[21] Appl. No.: 801,187

[22] Filed: Nov. 25, 1985

Related U.S. Application Data

[63] Continuation-in-part of Ser. No. 498,347, May 26, 1983, Pat. No. 4,608,742.

[51] Int. Cl.[4] ..... B23P 25/00

[52] U.S. Cl. ..... 29/458; 29/505

[58] Field of Search ..... 29/458, 522 R, 505, 29/521, 520, 512; 252/12, 25

[56] References Cited

U.S. PATENT DOCUMENTS

| | | | |
|---|---|---|---|
| 868,419 | 10/1907 | Emmet . | |
| 873,344 | 12/1907 | Boyce et al. . | |
| 1,006,263 | 10/1911 | O'Leary | 29/520 |
| 1,848,083 | 3/1932 | Wetherald | 29/520 |
| 2,050,993 | 8/1936 | Bush . | |
| 2,753,624 | 7/1956 | Taylor . | |
| 2,804,679 | 9/1957 | Tracy . | |
| 2,899,224 | 8/1959 | Elliott . | |
| 2,958,759 | 11/1960 | Snell . | |
| 2,960,466 | 11/1960 | Saunders | 252/25 |
| 3,010,198 | 11/1961 | Hanink et al. | 29/458 |
| 3,209,437 | 10/1965 | Voorhies . | |
| 3,460,429 | 8/1969 | La Torre . | |
| 3,829,957 | 8/1974 | Pouch et al. . | |
| 3,958,389 | 5/1976 | Whiteside et al. . | |
| 3,995,406 | 12/1976 | Rosman . | |
| 4,015,765 | 4/1977 | Ahmed | 29/522 X |
| 4,059,214 | 10/1977 | Weissman . | |
| 4,202,523 | 5/1980 | Radtke | 252/25 X |
| 4,249,298 | 2/1981 | Kanamaru et al. . | |
| 4,608,742 | 9/1986 | Ferguson et al. | 29/458 |

FOREIGN PATENT DOCUMENTS

| | | | |
|---|---|---|---|
| 248601 | 10/1962 | Australia | 29/522 |
| 8326 | 3/1980 | European Pat. Off. | 29/458 |
| 146874 | 11/1981 | Japan | 252/12 |
| 1339968 | 1/1979 | Netherlands | 252/25 |
| 1186376 | 4/1970 | United Kingdom . | |
| 2038682 | 7/1980 | United Kingdom . | |

*Primary Examiner*—Mark Rosenbaum
*Assistant Examiner*—Joseph M. Gorski
*Attorney, Agent, or Firm*—Christopher H. Morgan

[57] ABSTRACT

A mechanically rigid joint is formed between two different metals by completing the joint in a forging operation. A part (14) made of one metal is placed in a die form (20) and is maintained at a temperature below that required for forging. A billet (23) made of the material from which the second part (13) is to be formed is coated with boron nitride at an interface (16). The boron nitride is thermally treated while on the billet (23) by heating the coated billet (23) in a non-oxidizing atmosphere. The billet (23) may then be heated and placed in the die (20) so that the billet (23) can be formed into the second part (13), engaging the first part (14) at an interface (16) defining the joint. The joint (16) is stabilized by providing suitable coatings for the materials, particularly at the interface (16).

16 Claims, 3 Drawing Sheets

FORGED DISSIMILAR METAL ASSEMBLY AND METHOD

CROSS-REFERENCE TO RELATED APPLICATION

This is a continuation-in-part to U.S. application Ser. No. 498,347, filed May 26, 1983, now U.S. Pat. No. 4,608,742.

BACKGROUND OF THE INVENTION

This invention relates to forging and more specifically to methods for making a component part of two dissimilar non-weldable materials. In particular, the invention relates to a forging process for producing a bi-metal mechanical joint between a forged titanium member and a member made of a dissimilar metal.

In aircraft and aerospace and industries composite parts made from dissimilar metals are often used. A typical example is a titanium turbine wheel disc mounted on a hardened steel shaft. Currently the titanium disc is bolted to the steel shaft. The hole in the cener of the titanium disc reduces its structual integrity and therefore, the thickness of the disc has to be increased to maintain the operating stresses at an acceptable level. The current state of the art for welding dissimilar metals, such as titanium and steel, results in a brittle joint which is seldom structurally useful and is incapable of carrying a reasonable load.

The known prior art teaches either using a relatively soft cold workable material and a relatively hard material for making mechanical joints between two dissimilar materials, or when both parts to be joined are of a hard material, heating the part to be deformed. In the latter case, the mating portions of the two parts to be joined need to be machined to close tolerances, so that a minimum of deformation of the heated part is required.

It is, therefore, an object of the present invention to provide a joint between two dissimilar metal parts in which one of the parts is forged during the formation of the joint. The deformed part must remain mechanically secure within the non-deformed part in such a way as to avoid looseness or fretting between the joined parts. Since the non-deformed part remains with the formed part when the joint is made, it is important that the interface of the two parts include materials which retard or prevent dissimilar metals corrosion and do not otherwise create problems during the lifetime of the part. On the other hand, it is important that steps be taken to avoid oxidation, which would occur during the forging operation with the titanium and with any other active metals forming the joint. It is also to provide a joint between titanium and dissimilar metals in which the size of the joint is reduced over that of the prior art and requirements for further fastening techniques in the joint are reduced.

SUMMARY OF THE INVENTION

This invention relates to a method for making a mechanical joint between two dissimilar metals having similar hardness properties, in which the joint is accomplished during the forging of one of the parts. In particular, the invention relates to the combination of titanium with a diverse metal, such as steel or aluminum, in which the diverse metal has formed thereon its portion of the joint. The diverse metal is positioned in a forging die used to forge the titanium to a forged shape. When the forging operation is completed, the titanium conforms to the shape of the diverse metal, including the shape of the diverse metal's portion of the joint. In order that the diverse metal retains a relative dimension at the joint which conforms to the operating dimensions of the titanium, the diverse metal is heated to a temperature sufficient to compensate for expansion at elevated temperatures and yet low enough to avoid substantial deformation by the diverse metal during the forging operation.

In order to prevent oxidation of the titanium and of the diverse metal at the interface between the two parts, a boron nitride lubricant is applied to the titanium. Prior to forging, the coated titanium is heated in a non-oxidizing atmosphere, thereby causing the boron nitride to change its crystalline structure. This recrystallization prevents the boron nitride from oxidizing. The boron nitride inhibits oxidation of the titanium during forging and does not form an abrasive surface between the parts. Dissimilar metal corrosion may be further prevented by plating one of the parts at the joint prior to forging.

DETAILED DESCRIPTION OF THE PREFERRED EMBODIMENT

Figure 1:
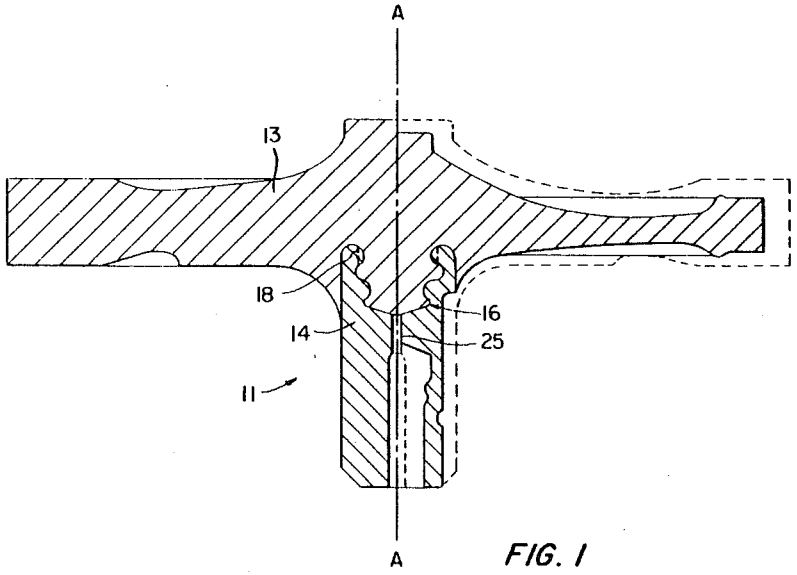
FIG. 1 is an axial sectional view of a bimetallic turbine wheel formed in accordance with the invention illustrated prior to being completed by machining operations subsequent to being forged (left), and as completed (right)

Referring to FIG. 1, a bi-metallic turbine wheel 11 formed in accordance with the invention is shown in cross section along its center axis A—A. To the left of the axis A—A, the turbine wheel 11 is shown as machined, with the outlines of the original forging being shown in phantom. To the right of the center axis A—A, the turbine wheel 11 is shown as originally forged, prior to final machining operations. The turbine wheel 11 consists of a titanium disc 13 and a shaft 14. The shaft is preferrably made of steel, but may be of an alloy of any Group 8 metal. The disc 13 and shaft 14 are in intimate contact at an interface 16. The interface 16 is appropriately curved so as to prevent axial separation of the disc 13 from the shaft 14. In order to lock the disc 13 into rotational alignment with the shaft 14, a plurality of keyways 18 are bored about an inner circumference of the shaft 14 at the interface 16, with the disc 13 conforming to the keyways 18 at the interface 16. With this arrangement, the disc 13 is secured to the shaft 14 without the benefit of fasteners or bonding techniques.

As can be seen, final machining of exterior parts of the turbine wheel 11 is accomplished after forging. Thus, the external shape of both the disc 13 and the shaft 14 are established after the forging operation. The shape of the interface 16 is established during forging on the disc 13 and is accomplished by machining operations on the shaft 14 prior to forging the turbine wheel 11.

For the purposes of this description, "forging" of the turbine wheel is intended to refer to a forging operation in which the disc 13 is forged onto the shaft 14. While it is likely that in many cases, the shaft 14 will also be formed by forging, this operation occurs prior to machining and forms no part of the invention. For this reason, the description of the forging operation will refer only to the procedure for forging the disc 13 onto the shaft 14.

Figure 2:
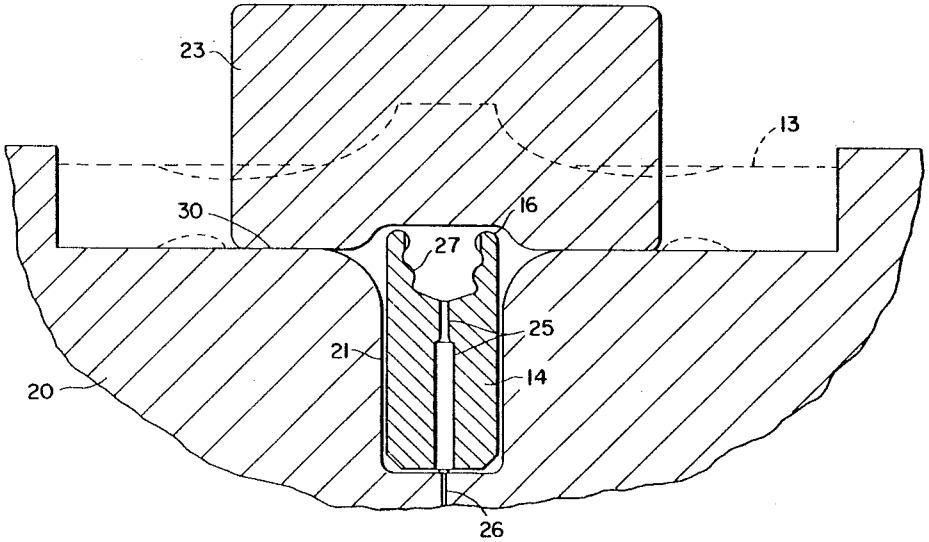
FIG. 2 shows the placement of a billet on a lower forging die prior to forging the turbine wheel of FIG. 1.

FIG. 2 shows the shaft 14 in place in a lower forging die form 20. The shaft 14 has been placed in a receiving cavity 21 in the lower die form 20, with the interface 16 exposed. A titanium billet 23 is placed on the lower die form 20 over the shaft 14 so that the billet 23 can be forged into the disc 13. The shaft 14 has been prepared by completely machining the shaft 14 at the interface 16, including drilling the keyways 18 prior to shaping the interface 16 and smoothing the keyways 18. A vent hole 25 has been provided in the shaft 14 and communicates with a corresponding vent hole 26 in the lower die form 20. As will be seen later, the vent holes 25, 26 allow the billet 23 to be forged into an inside cavity portion 27 of the shaft 14 at the interface 16.

In order to forge the titanium disc 13 onto the steel shaft 14, the materials must be heated to appropriate temperatures so that the titanium billet 23 deforms, without substantially deforming the steel shaft 14. The ability of the steel shaft 14 to retain its shape is of particular importance at the interface 16 because the shape of the interface 16 is important in retaining the disc 13 on the shaft 14 when the turbine wheel 11 is placed in service.

In order to forge the disc 13 and shaft 14 together, the titanium billet 23 is provided in a plastic state and is placed on the lower die 20 in the manner stated. The billet 23 is heated to a temperature of plasticity in order that the titanium billet material is sufficiently malleable to be forged by the die (not completely shown) to thereby become the disc 13. Since the steel shaft 14 is approximately in its final shape at the time of forging, the shaft 14 must be at a temperature below its temperature of plasticity in order that it not be significantly deformed during forging operations. In the preferred embodiment, the billet 23 is heated prior to forging to a temperature of approximately 1100° C. (2000° F.). The forging temperature is, of course, greater than the operating temperature of the turbine wheel 11. This results in the turbine wheel 11 operating with the turbine disc 13 being contracted from its size at the time of forging. Since the size of the turbine disc 13 is critical at the interface 16, a contraction in size may have a tendency of loosening the disc 13 from the shaft 14. Some of this loosening can be compensated for by forming appropriate locking surfaces on the outer circumference of the shaft 14. In any event, however, the effectiveness of the inside portion 47 of the interface 16 as locking means would be reduced by excessive contraction. In contrast, the preferred embodiment provides that the fit between the disc 13 and the shaft 14 at the inside portion 27 of the interface 16 is a very close interference fit. In order to accomplish this, the shaft 14 is pre-heated to an elevated temperature prior to forging so that during forging, the shaft 14 remains at an elevated temperature.

As mentioned, supra, the shaft 14 must be below a temperature of plasticity. In the preferred embodiment, the shaft 14 is heated to 650° C. (1200° F.). This temperature may very, although the temperature of the shaft 14 should be below approximately 815° C. (1500° F.) during the forging of the disc 13 in order to avoid the deformation of the shaft 14 at the interface 16. Such deformation must be avoided to the extent that the integrity of the lock between the disc 13 and the shaft 14 would otherwise be compromised. By forging the turbine wheel assembly 11 with the shaft 14 heated to 650° C., the shaft 14 contracts when the turbine wheel 11 is cold after forging the disc 13. Thus, even though the disc 13 has contracted, the contraction of the shaft 14 insures that an interference fit exists between the disc 13 and the shaft 14 at the inside portion 27 of the interface 16. This also places tensile stress on the steel shaft 14 rather than on the titanium disc 13.

As is well known to those skilled in the art of metallurgy, the component materials which form the shaft 14 and disc 13 tend to oxidize considerably when heated for the forging operation. While this creates some problems in the case of the steel shaft 14, these problems of oxidation are significant in the case of the titanium which is heated to a temperature of plasticity. For this reason, it is common to use a die lubricant whose primary functions are to inhibit oxidation and prevent the fusion of a forged material with a die. In the case of titanium, a suitable lubricant would be Apex Precoat 2000, manufactured by Apex Alkali Products Company of Philadelphia. This is a ceramic pre-coating, which is normally applied by dip application and dried prior to a furnace heating cycle. The steel shaft 14 would also be protected by a suitable die lubricant. Apex Precoat 306 compound from the aforementioned Apex Co. is a preferred material for such purposes, even though the precoat material was originally designed for the protection of titanium. Apex Precoat 306 is a liquid dip coating of resins and colloidal graphite. Unfortunately, both Apex Precoat 2000 and Apex Precoat 306 are unsuitable for use at the interface 16 because of the solid materials which would be left behind. The Apex Precoat 2000, in particular, leaves a ceramic residue, which would cause fretting or abrasion at the interface 16. While the graphite residue of Apex 306 would create less problems, such a material has a potential for increasing dissimilar metal corrosion at the interface 16. The present invention contemplates the titanium billet 23 being coated with a non-ceramic die lubricant at a bottom surface 30 of the billet 23 corresponding to the interface 16 at the disc 13. The use of ceramic and graphite lubricants on the steel shaft 14 at the interface 16 is preferably also avoided.

The non-ceramic die lubricant is coated onto the bottom surface 30 of the billet 23. In the preferred embodiment, the non-ceramic die lubricant is a boron nitride (BN) coating, sold by the Carbondum Company, Graphite Products Division, of Niagara Falls, N.Y., as an aerosol spray in an inorganic binder. The boron nitride can also be applied by airless spraying equipment and by other methods. It has a hexgonal crystalline structure, resembling that of graphite, but is considered to be a dielectric material.

It has been found that the boron nitride coating oxidizes or otherwise changes at approximately 700° C. (1300° F.) when heated in an oxidizing atmosphere. After the change, the boron nitride coating becomes crusty and flaky, thereby making it unsuitable for protecting the surface of the metal onto which the boron nitride is coated. It has been found that by heating the boron nitride in an inert atmosphere to a temperature of 925° C. (1700° F.) for twenty minutes, the boron nitride coating changes properties and thereafter can be heated in an oxidizing atmosphere in preparation for forging without deteriorating. Instead of becoming crumbly, the boron nitride coating, which is white in appearance when originally coated onto metal parts for forging, changes to a dark grey or black finish and does not become crusty or flaky. The black boron nitride has the texture and appearance of graphite powder and the outer surface of the coating easily rubs off on one's hands when touched.

The boron nitride coating, after having been preheated in an inert atmosphere, remains as it emerged from having been heated in the inert atmosphere and does not become crusty and flaky when it is later preheated in a oxidizing atmosphere prior to forging. Since the boron nitride coating tends to oxidize at above 700°, it is believed that a transformation takes place in the boron nitride at approximately that temperature, and that this change results in the boron nitride coating assuming the change from white to black when heated in the inert atmosphere. We have found that the black boron nitride finish no longer becomes crusty or flaky when preheated, which leads us to believe that whatever transformation takes place with the boron nitride coating is permanent as far as preventing the change of the coating to a crusty or flaky finish at forging temperatures. Despite these changes, the boron nitride coating retains its hexagonal crystalline structure, although there may be more impurities within the crystalline structure of the black boron nitride.

In the preferred embodiment, the metal parts, after having been coated with the boron nitride coating, are heated in an inert atmosphere of argon gas for twenty minutes. Presently the most preferred temperature range for heating the boron nitride coated part in the argon atmosphere is 925°-955° C. (1700°-1750° F.). The minimum temperature to which the material must be heated in the inert atmosphere is believed to be over 600° C. (1050° F.), or approximately 700° C., although this has not been verified. The maximum preferred temperature for heating a titanium billet with a boron nitride coating in the inert atmosphere would be below 1150° C., at which temperature the titanium would recrystallize to become brittle. While an inert atmosphere is used in the preferred embodiment, it is anticipated that a reducing atmosphere could also be used for heating the boron nitride coated billet so as to change the coating from the white state to the black state. It is also anticipated that the step of changing the coating from white to black can be combined with the pre-forging preheat step.

The steel shaft is preferably protected at the interface 16 by metal plating. At present, electroless nickel plating is used, although other types of plating may be necessary if metallurgical tests or microscopic examinations indicate that corrosion to the interface 16 becomes a problem. Regardless of the specific plating used for the steel shank 14, the combination of the nonceramic bottom surface 30 with the plating of the interface portion 16 of the shaft 14 is used to provide a secure and lasting joint between the disc 13 and the shaft 14. The plating is also intended to diminish dissimilar metal corrosion at the interface 16.

As indicated supra, the preferred temperature for heating the titanium billet 23 for forging is 1100° C. It has been found that at temperatures about 1150° C. (2100° F.), the titanium becomes brittle. At temperatures below 925° C. (1700° F.), the titanium is not plastic enough to render a suitable forged part. The preferred temperature range is, therefore, between 980° C. and 1100° C. (1800° F. and 2000° F.). As indicated supra, the shaft 14 is preferably heated to approximately 650° C., with 815° C. being an approximate temperature at which significant deformation may take place during the forging operations. Since the titanium billet 23 is at a higher temperature, the temperature of the shaft 14 must be initially lower than that of the maximum temperature of no significant deformation. The minimum temperature for the shaft is ambient, although the aforementioned problems of relative expansion and contraction would result in an unstable joint if the shaft 14 is not pre-heated.

After the billet 23 is forged into the disc 13, the resulting turbine wheel 11 is then machined as indicated on the left side of FIG. 1. The final machining of the shaft 14 after forging the disc 13 causes the shaft, which has more material before machining, to have more structural rigidity during forging and nullifies any effect which the forging operation may have on surfaces on the shaft 14. As can be seen, the resulting configuration avoids the use of extra materials in the final machined product. The extra materials would normally be required for fixing the disc 13 to the shaft 14 if fasteners were used.

Figure 3:
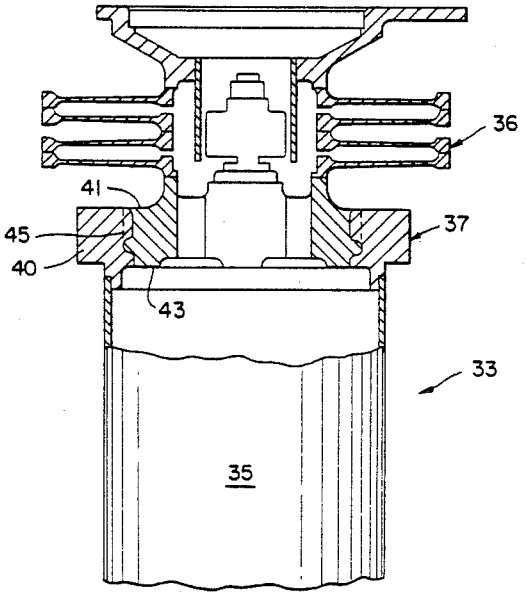
FIG. 3 shows a bi-metallic transition ring formed in accordance with the invention used for coupling a power transmission shaft to a flexure diaphragm.

Referring to FIG. 3, a power transmission shaft 33 is shown in which an aluminum center tube 35 is connected to a titanium diaphragm pack 36. The diaphragm pack 36 is connected to the center tube 35 by means of a transition ring 37. An outer part 40 is made of aluminum and is joined to a titanium inner part 41. The center tube 35 is welded to the transition ring 37 at the outer part by appropriate welding techniques. Likewise, the diaphragm pack 36 is welded to the transition ring 37 at the titanium inner part 41, so that the welded joints are being between two like metals.

In order to form the transition ring, the outer part 4 is first formed, as by forging. An inner surface, which will become an interface 43 between the inner and outer parts 40, 41, is then machined with locking keyways 45 being bored along the surface of the interface 43. The outer part 40 is then coated with Apex Precoat 306 except at the interface 43. The interface 43 is coated with boron nitride. A titanium billet (not shown) is prepared by coating those surfaces which will appear at the interface 43 with boron nitride. The remaining surfaces of the titanium billet are coated with Apex Precoat 2000.

As stated supra, the boron nitride coating is preheated in the inert atmosphere in order to change the boron nitride coating from the white state to the black state.

The outer part 40 is pre-heated to approximately 150° C. (300° F.). The titanium billet is heated to approximately 1100° C. (2000° F.) and inserted on a lower die form (not shown). When resting on the lower die form, the titanium billet is surrounded by the outer part 40 so that the interface portion 43 of the outer part 40 faces the billet. The billet is then forged to form the inner part 41, and is thereby locked into place against the outer part 40 to form the transition ring 37. The transition ring 37 is then machined into its final shape. After being machined, the transition ring may be welded to the center tube 35 and the diaphragm pack 36 as indicated.

The temperature range for the titanium billet which forms the inner part 41 is the same as the temperature range for billet 23 forming the disc 13 in the turbine wheel 11. The temperature range for the aluminum outer part 40 is different from that of the steel shaft 14, but it is still determined by the same criteria. In other words, the ideal temperature range for the aluminum outer part 40 is determined by the minimum temperature required to ensure a sufficiently tight fit at operating temperatures and by the maximum temperature at which the aluminum will retain its structural integrity. For the construction of the transition ring 37 described, a hoop stress in the aluminum outer part 40 is created, which insures a tight joint but yet does not significantly reduce the torque-carrying capability of the transition ring 37. While an estimate of the appropriate temperatures for the component parts can be made for a given fit, the final temperatures must be determined empirically because the ability of the materials to transfer heat at their boundaries during the forging operation is difficult to calculate. The aluminum outer part 40 is preferably heated to 150° C. (300° F.). A preferred temperature range for the aluminum would, therefore, be between ambient and up to 230° C. (450° F.). It is anticipated that the temperature for the aluminum part may be up to 550° C. (1020° F.).

The foregoing were examples of the inventive process being applied to construct exemplary products. Clearly, numerous variations can be made to the steps described herein while remaining within the spirit of the invention. For this reason, it is desired that the invention be limited only by the claims.

What is claimed is:

1. Method of producing a component having a rigid joint between two dissimilar metals in a forging operation, comprising the steps of:

(a) providing a first metal part in a predetermined shape;

(b) determining an interface between the first part and a second metal part;

(c) machining the first part into a final form at the interface;

(d) plating the first part at the interface with a plating material having a property of inhibiting dissimilar metal corrosion;

(e) coating a billet, of the metal from which the second metal part is to be formed, with boron nitride where the billet is to contact the interface in the forging operation;

(f) heating the boron nitride coated billet in a nonoxidizing atmosphere at a temperature sufficient for the boron nitride to change from a white state to a black state, thereby heating the boron nitride and changing the boron nitride from a white state to a black state, prior to the forging operation;

(g) establishing the first part at a temperature below that required for plastic deformation during the forging operation;

(h) heating the billet to a forging temperature;

(i) placing the first part into a pre-determined position in a forging die;

(j) placing the billet into a second pre-determined position in the forging die;

(k) applying forging pressure against the billet, thereby forming the billet into the second part, and thereby joining the second part to the first part at the interface; and (l) machining the joined parts to produce said component.

2. Method as described in claim 1 further characterized by:

the plating material being nickel.

3. Method as described in claim 1 further characterized by:

the plating material being nickel, and applying said nickel by an electroless plating operation.

4. Method as described in claim 1 further characterized by:

(a) the boron nitride having a hexagonal crystalline structure when it is first coated onto the billet; and (b) the boron nitride having substantially a hexagonal crystalline structure after said heating in the non-oxidizing atmosphere.

5. Method as described in claim 1 further characterized by:

the step of establishing the first part at a temperature including establishing the first part at a temperature which is determined by relative coefficients of expansion of the two parts such that, when the component is cooled to operating temperatures, the two parts at the interface fit against one another in such a manner that when a desired amount of pressure is applied between the parts at the interface the joint remains stable and the parts do not fracture because of excessive pressure at the interface.

6. Method described in claim 5 further characterized by:

(a) the boron nitride having a hexagonal crystalline structure when it is first coated onto the billet; and (b) the boron nitride having substantially a hexagonal crystalline structure after said heating in the non-oxidizing atmosphere.

7. Method as described in claim 1 further characterized by:

(a) the first part being made of an alloy consisting primarily of a Group 8 metal; and (b) the second part being made of a metal consisting primarily of titanium.

8. Method as described in claim 7 further characterized by:

(a) the boron nitride having a hexagonal crystalline structure when it is first coated onto the billet; and (b) the boron nitride having substantially a hexagonal crystalline structure after said heating in the non-oxidizing atmosphere.

9. Method as described in claim 1 further characterized by:

(a) the first part being made of steel;

(b) the second part being formed primarily of titanium;

(c) heating the first part to a temperature below 815° C. prior to applying said forging pressure; and (d) heating the to a temperature of between 980° C. and 1100° C.

10. Method as described in claim 1 further characterized by:

coating the billet with a ceramic coating where the billet is not coated with the boron nitride.

11. Method as described in claim 10 further characterized by:

heating the boron nitride coated part in a non-oxidizing atmosphere at a temperature in excess of 600° C.

12. Method of forming a component having a rigid joint between a first metal part and a titanium part in a forging operation, comprising the setups of:

(a) providing the first metal part in a predetermined shape;

(b) determining an interface between the first part and the titanium part;

(c) machining the first part into a final form at the interface;

(d) coating the first part at the interface with a first coating material having a property of inhibiting oxidation during the forging operation with the first coating material being suitable for remaining in the joint at the interface when the component is placed into service;

(e) coating a billet of titanium, from which the titanium part is to be formed, with boron nitride where the billet is to contact the interface when said forging pressure is applied, the boron nitride having a hexagonal crystalline structure during said coating;

(f) heating the boron nitride in a non-oxidizing atmosphere at a temperature sufficient for the boron nitride to change from a while state to a black state by heating the billet in said non-oxidizing atmosphere prior to applying said forging pressure thereby changing the boron nitride from a white state to a black state, the boron nitride having substantially a hexagonal crystalline structure after said heating;

(g) establising the first part at a temperature below that required for plastic deformation during the forging operation;

(h) heating the billet to a forging temperature;

(i) placing the first part into a pre-determined position in a forging die;

(j) placing the billet into a second pre-determined position in the forging die;

(k) applying forging pressure against the billet thereby forming the billet into the titanium part, and thereby joining the titanium part to the first part at the interface; and (l) machining the joined parts to produce said component.

13. Method as described in claim 12 further characterized by:

the first part being primarily aluminum.

14. Method as described in claim 12 further characterized by:

the step of establishing the first part at a temperature establishing the first part at a temperature which is determined by the relative coefficients of expansion of the two parts such that, when the component is cooled to operating temperatures, the two parts at the interface fit against one another in such a manner that when a desired amount of pressure is applied between the parts at the interface the joint remains stable and the parts do not fracture because of excessive pressure at the interface.

15. Method as described in claim 14 further characterized by:

heating the boron nitride coated billet to a temperature in excess of 600° in a non-oxidizing atmosphere prior to the application of forging pressure.

16. Method as described in claim 15 further characterized by:

coating the billet with a ceramic coating where the billet is not coated with the boron nitride.

* * * * *

UNITED STATES PATENT AND TRADEMARK OFFICE

CERTIFICATE OF CORRECTION

PATENT NO. : 4,780,948

DATED : November 1, 1988

INVENTOR(S) : John H. Ferguson et al

It is certified that error appears in the above-identified patent and that said Letters Patent is hereby corrected as shown below:

In Claim 9 (d), Line 49, add word "billet" after "the".

Signed and Sealed this

Twenty-eighth Day of March, 1989

*Attest:*

DONALD J. QUIGG

*Attesting Officer*

*Commissioner of Patents and Trademarks*